US006173928B1

(12) United States Patent
Coats

(10) Patent No.: US 6,173,928 B1
(45) Date of Patent: Jan. 16, 2001

(54) STABILIZER FOR INFLATION PUMP FOR INFLATABLE BALLS AND THE LIKE

(76) Inventor: Andrew Owen Coats, 15710 Mesa Gardens Dr., Houston, TX (US) 77095

( * ) Notice: Under 35 U.S.C. 154(b), the term of this patent shall be extended for 0 days.

(21) Appl. No.: 09/261,639

(22) Filed: Mar. 3, 1999

(51) Int. Cl.[7] ..... F16M 11/38

(52) U.S. Cl. ..... 248/171; 248/122.1; 248/125.1; 248/519; 248/176.3; 417/234; 417/545; 417/360

(58) Field of Search ..... 248/122.1, 125.1, 248/519, 176.3; 417/234, 545, 572, 360

(56) References Cited

U.S. PATENT DOCUMENTS

| | | | | |
|---|---|---|---|---|
| 4,245,666 | * | 1/1981 | Norris | 248/171 X |
| 5,026,261 | * | 6/1991 | Jou | 417/234 X |
| 5,433,136 | * | 7/1995 | Lung-Po | 417/234 X |
| 5,947,706 | * | 9/1999 | Gapinski | 248/125.1 |
| 6,017,201 | * | 1/2000 | Yang | 417/572 X |

* cited by examiner

*Primary Examiner*—Anita M. King
*Assistant Examiner*—A. Joseph Wujciak
(74) *Attorney, Agent, or Firm*—Bracewell & Patterson, LLP

(57) ABSTRACT

A pump stabilizer stabilizes the position of the needle of a cylinder-type hand-held sport ball pump relative to the sport ball assuring that the needle is not bent or broken-off during the inflation pumping action, while permitting the pump cylinder to be held in one hand and the pump piston handle to be held in the other in typical fashion. The outer cylinder of the pump is fitted with a sliding peripheral ring. The needle end of the pump includes a mounting ring having three mounting tabs or brackets equilaterally spaced about the ring. Three legs are pivotably mounted on the sliding ring and secured to the mounting ring by hinged extensions, permitting the sliding ring to move along the axis of the cylinder and the legs to telescope in and out relative to the cylinder. When the needle is inserted in the orifice of the ball, the legs are telescoped down along the cylinder until they are in firm engagement with the ball. A locking device secures the assembly in place during the pumping action.

15 Claims, 2 Drawing Sheets

STABILIZER FOR INFLATION PUMP FOR INFLATABLE BALLS AND THE LIKE

BACKGROUND OF THE INVENTION

1. Field of the Invention

The subject invention is generally related to a device for stabilizing an air pump relative to an inflatable member and is specifically directed to an apparatus for stabilizing the air pump relative to a ball or the like for assuring that the needle is not bent or broken-off in the ball orifice.

2. Description of the Prior Art

Hand held air pumps are well known for inflatable balls such as footballs, basketballs, soccer balls, volley balls and the like, generally referred to as inflatable sport balls herein. Typically, the air pump includes an outer hollow cylinder with opposite closed ends. One end is adapted for mounting an inflation needle which is a narrow, hollow tube with a hole at each end, one end of which is adapted to be mounted on the pump cylinder and the other end of which is adapted to be inserted into a receptive orifice in the inflatable sport ball. The opposite end of the pump handle also includes an opening for receiving an elongated plunger. A pump piston is mounted inside the cylinder on one end of the plunger. A handle is mounted on the other end of the plunger, whereby pumping the handle in and out of the cylinder causes the piston to pump air into the needle and through the needle into the inflatable sport ball.

One of the problems with this device is that it is generally required that the user place one hand on the cylinder and the other hand on the handle in order to pump air into the ball. This permits the ball to move relative to the needle, often bending the needle, or worse, breaking the needle off inside the ball. This problem has damaged many needles beyond use and at times has ruined an otherwise perfectly serviceable inflatable sport ball.

Even with other inflation devices available, such as power compressors and the like, the cylinder-type, hand-held sport ball inflation pump continues in wide spread use today. The cylinder pump is inexpensive, portable and because of its design, provides assurance that the ball will not be quickly overinflated and ruined, as is often the case with power compressors and the like. Therefore, even with the drawbacks of the current cylinder-type inflation pump, it continues to be the inflation pump of choice for inflating low-volume, low-pressure sporting equipment.

SUMMARY OF THE INVENTION

The subject invention is directed to a sport ball inflation pump of the hand-held cylinder-type which has been improved to assure that the needle is neither bent nor broken-off during the pumping process. The pump stabilizer of the subject invention stabilizes the position of the needle relative to the pump and the sport ball assuring that the needle is not bent or broken-off during the inflation pumping action, while permitting the pump cylinder to be held in one hand and the pump piston handle to be held in the other in typical fashion.

Specifically, the outer cylinder of the pump is fitted with a sliding peripheral ring. The needle end of the pump cylinder includes a mounting ring having three mounting tabs or brackets equilaterally spaced about the ring. Three legs are pivotally mounted on the sliding ring and secured to the mounting ring by hinged extensions, permitting the sliding ring to move along the axis of the cylinder and the legs to "telescope" in and out relative to the cylinder.

When the needle is inserted in the orifice of the ball, the legs are telescoped down along the cylinder until they are in firm engagement with the ball. This assures that the orifice, needle and cylinder maintain axial alignment.

In the preferred embodiment of the invention, the sliding ring includes a locking device such as a set screw for securing it in place once the needle is properly seated in the orifice and the legs are secured against the periphery of the ball. The preferred embodiment of the invention also includes a container mounted on one of the legs for holding the needle when not in use, further protecting the needle from damage. The container may be an integral feature of the leg such as within in a hollow leg, or may be mounted elsewhere on the system.

It is, therefore, an object and feature of the subject invention to provide for a means and apparatus for positionally securing a hand-held inflation pump relative to a device to be inflated.

It is also an object and feature of the subject invention to provide for a means and apparatus for securing a pump cylinder in axial alignment with a pump needle during the pumping action on a hand-held, cylinder-type sport ball pump.

It is a further object and feature of the subject invention to provide a tripod-type stabilizing device for stabilizing a pump and needle relative to a sport ball during an inflation pumping operation.

Other objects and features of the invention will be readily apparent from the accompanying drawings and detailed description of the preferred embodiment.

DETAILED DESCRIPTION OF THE PREFERRED EMBODIMENTS

Figure 1:
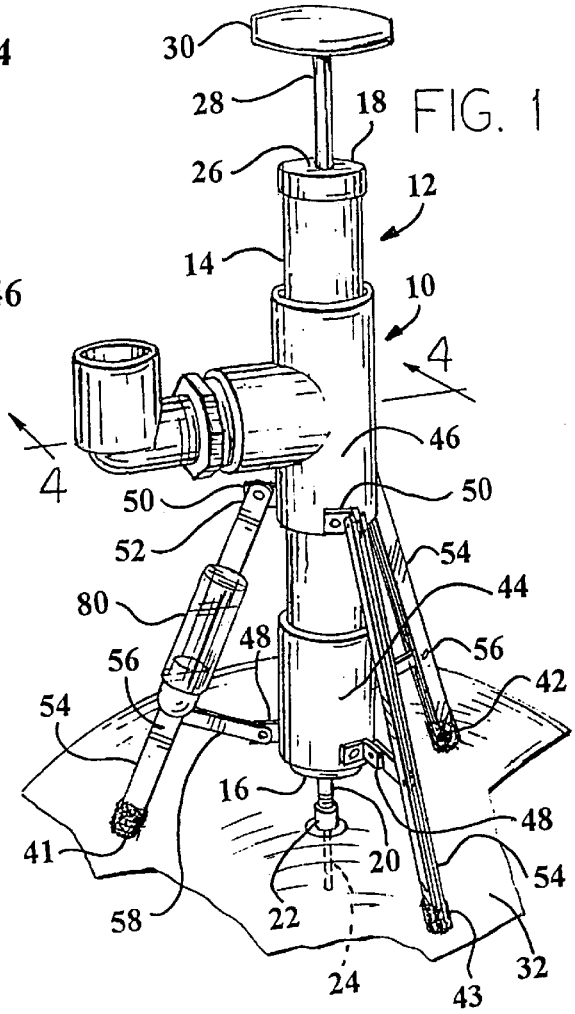
FIG. 1 is a perspective view of a prototype of the stabilizer of the subject invention shown mounted on a hand-held cylinder-type sport ball inflation pump.

With specific reference to FIG. 1, the stabilizer 10 of the subject invention is adapted to be mounted directly on a standard hand-held cylinder-type sport ball inflation pump 12. The typical pump 12 includes an outer, hollow cylinder 14 having a pair of endcaps 16 and 18. One endcap 16 includes a threaded nipple 20 adapted for receiving the threaded enlarged base 22 of a typical inflation needle 24. The other endcap 18 includes a hole 26 adapted for accommodating the plunger 28 of the pump. The plunger 28 includes an outer handle 30 for grasping the plunger and pumping it relative to the cylinder. A piston (not shown) is mounted on the plunger 28 inside the cylinder 14 for expanding and contracting the working chamber of the cylinder to compress and pump air into the sport ball 32.

The stabilizer 10 of the subject invention includes three stabilizer contacts tips 41, 42 and 43 for securing the sport ball 32 in a fixed position relative to the needle 24. As specifically shown in the FIGS. 1–4, the stabilizer includes a base ring 44 mounted on the cylinder 14 adjacent the needle endcap 16. In the preferred embodiment this ring is secured in place on the cylinder either by an adhesive or by a set-screw, not shown. The base ring could also be incorporated as an integral feature of the pump cylinder. A sliding ring 46 is also mounted on the cylinder 14.

Figure 2:
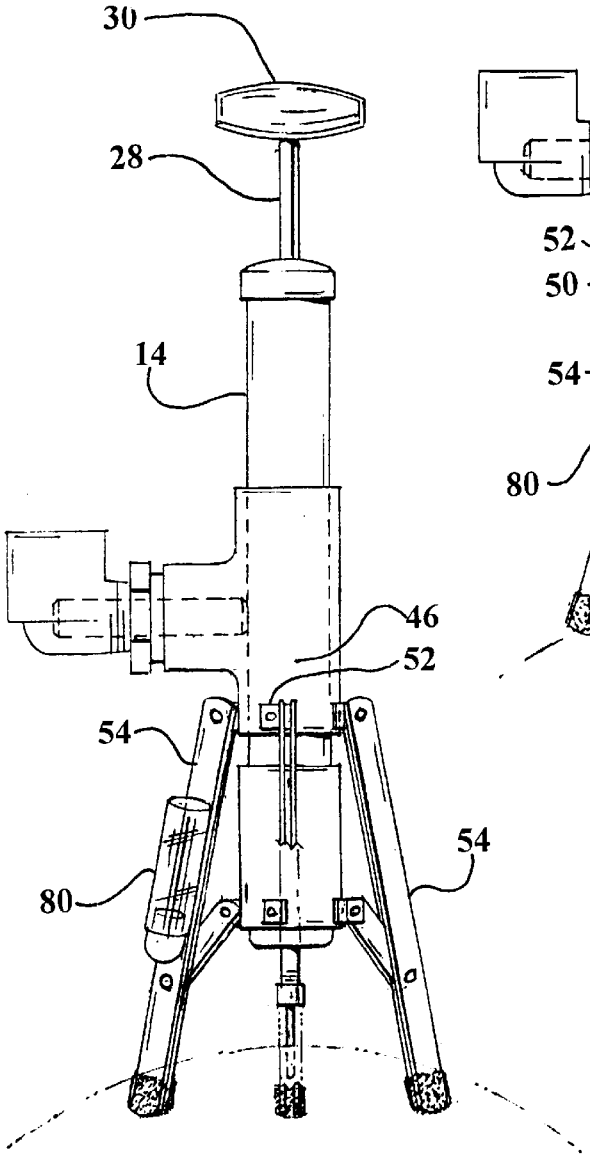
FIG. 2 is a side elevation view of the device in FIG. 1, showing the device prior to needle insertion.
Figure 3:
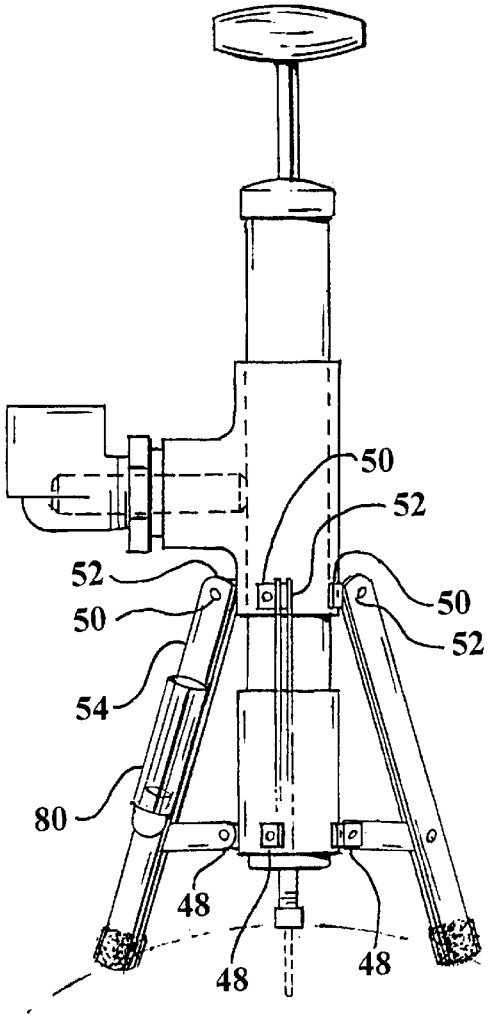
FIG. 3 is a view similar to FIG. 2, showing the device after needle insertion and proper seating of the stabilizer.

The base ring 44 includes three radially outwardly extending mounting tabs (see FIGS. 2 and 3). The sliding ring 46 also includes three similar outwardly extending mounting tabs 50. The upper end 52 of a leg 54 is pivotably mounted on the sliding ring tabs 50. An intermediate portion 56 of each leg 54 is pivotably mounted on an extension arm 58 which is, in turn, pivotably mounted on a base tab 48. The lower end of each leg terminates in one of the stabilizer contact tips 41, 42 and 43. In the preferred embodiment of the invention, the lower end of each leg includes a rubber or other non-skid tip or foot for protecting the sport ball surface and assuring a good high-friction contact point.

Figure 4:
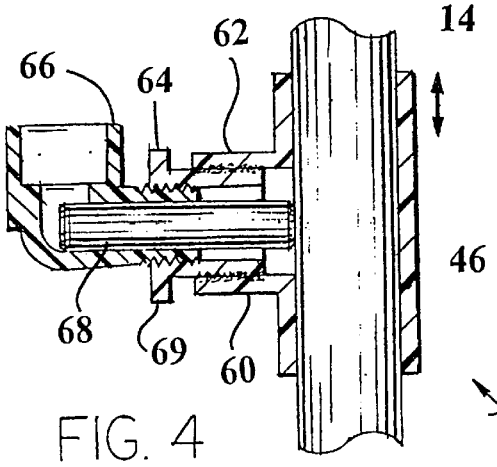
FIG. 4 is a section taken along the section line 4—4 of FIG. 1.

As best shown in FIG. 4, the sliding ring 46 includes a "Tee" or boss 60 having an internally threaded bore 62. In the prototype embodiment, a reducer 64 is received in the bore of the boss 60 and also includes an internally threaded bore 69. A stop member such as the wooden dowel rod or shaft 68 is carried in the chamber defined by the internal bores and is in radial relationship with the cylinder 14. An elbow 66 is carried in the threaded bore 69 of the reducer and may be turned into the bore such that the inner wall of the elbow engages the shaft 68 and lodges it against the cylinder 14 to secure the sliding ring 46 in place on the cylinder.

In use, and as shown in FIGS. 2 and 3, ring 46 is loose on cylinder 14 (FIG. 2) when the needle is first inserted in the orifice 22 of the ball 32. As the needle is fully inserted in the orifice (FIG. 3), the ring 47 slides up along the cylinder 14 with the tips 41, 42 and 43 of the legs 54 engaging the outer periphery of the ball 32. When the needle is fully inserted in the orifice, the set screw assembly (FIG. 4) is tightened and the ring 46 is secured in place with the leg tips 41, 42 and 43 engaging the outer periphery of the ball 32. This permits the ball to be inflated without the ball and needle moving relative to one another in such a way as to bend or break-off the needle.

Figure 5:
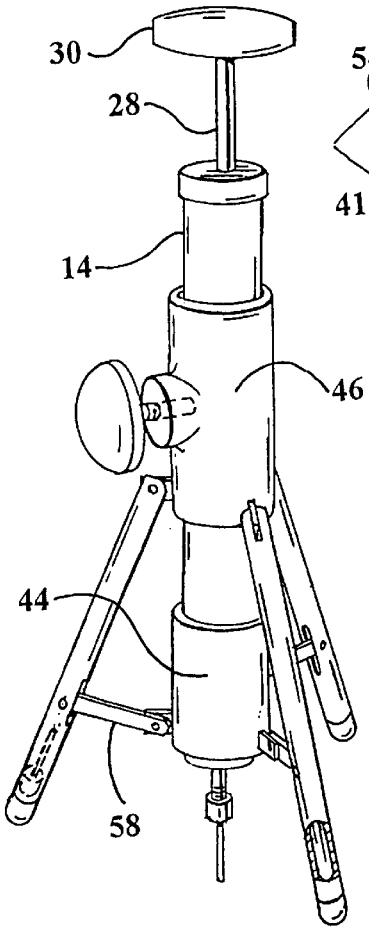
FIG. 5 is an illustration similar to FIG. 1 and showing a commercial version of the device.

A commercialized embodiment of the invention is shown in FIG. 5 and operates generally as above described. It will be noted that the set screw arrangement 100 has been streamlined and the legs 54 are encased in sheaths 102 for aesthetic purposes.

Another needle protection feature of the subject invention is the provision of a needle container 80 on one of the legs 54 for storing the needle when the pump is not in use. Spare needles may also be stored in the container. Of course, the needle storage container could be placed elsewhere on the device, such as within a hollow leg or on another portion of the device.

While certain embodiments and features of the invention have been shown in detail herein, it will be readily understood that the invention incorporates all of the modifications and enhancements within the scope and spirit of the following claims.

What is claimed is:

1. A stabilizer for a hand-held, cylinder-type sport ball pump having an outer cylinder with a plunger handle at one end of the cylinder and an inflation needle at the other end of the cylinder, the stabilizer comprising:

a. a plurality of stabilizer tips mounted on the sport ball when the pump is in engagement with the ball and for maintaining the position and axial alignment of the needle relative to the ball when the pump is in engagement with the ball;

b. a sliding member in engagement with the stabilizer tips and mounted in sliding relationship with the cylinder, whereby the position of the stabilizer tips relative to the cylinder may be adjusted; and c. a locking device for selectively locking the position of the sliding member and stabilizer tips relative to the cylinder.

2. The stabilizer of claim 1, wherein there is further included three stabilizer tips equilaterally spaced about the perimeter of the cylinder.

3. The stabilizer of claim 1, wherein each stabilizer tip includes a high-friction surface.

4. The stabilizer of claim 1, wherein each stabilizer tip comprises an elongated leg having one end secured to the sliding member and the other end extending beyond the outer end of the cylinder.

5. The stabilizer of claim 4, wherein the pump includes a detachable needle and wherein the stabilizer includes a needle storage container.

6. The stabilizer of claim 5, wherein the needle storage container is mounted on one of said legs.

7. The stabilizer of claim 4, further comprising a base ring at one end of the cylinder, the base ring including a plurality of mounting tabs, and the sliding member comprising a sliding ring mounted above the base ring and having a plurality of mounting tabs in alignment with the base ring mounting tabs, one end of the legs being pivotably mounted to the sliding ring mounting tabs and an intermediate portion of the legs being pivotably mounted to the base ring mounting tabs.

8. The stabilizer of claim 7, further comprising an extension arm between each base ring mounting tab and the intermediate portion of the respective leg.

9. The stabilizer of claim 7, wherein the locking device further comprises a locking assembly associated with the sliding ring for selectively securing the sliding ring in position relative to the cylinder.

10. The stabilizer of claim 9, wherein the locking device further comprises a set screw threadably carried in the sliding ring and having a locking end adapted to be moved into and out of locking engagement with the cylinder.

11. The stabilizer of claim 7, wherein the base ring is fixedly secured to the cylinder.

12. A stabilizer for a hand-held, cylinder-type sport ball pump having an outer cylinder with a plunger handle at one end of the cylinder and an inflation needle at the other end of the cylinder, the stabilizer comprising:

a. a base ring at one end of the cylinder, the base ring including a plurality of mounting tabs;

b. a sliding ring mounted above the base ring and having a plurality of mounting tabs in alignment with the base ring mounting tabs;

c. a plurality of elongated legs, each having one end pivotably secured to the sliding ring and the other end extending beyond the outer end of the cylinder, an intermediate portion of each leg being pivotably mounted to the base ring mounting tabs;

d. a stabilizer tip at said outer end of each leg mounted on the sport ball when the pump is in engagement with the ball and for maintaining the position and axial alignment of the needle relative to the ball when the pump is in engagement with the ball; and e. a locking device for selectively locking the position of the sliding ring and stabilizer tips relative to the cylinder.

13. The stabilizer of claim 12, wherein there is further included three legs equilaterally spaced about the perimeter of the cylinder.

14. The stabilizer of claim 12, wherein each stabilizer tip includes a high-friction surface.

15. The stabilizer of claim 12, further comprising a detachable needle and wherein one the legs includes a needle storage container.

* * * * *